US005594538A

United States Patent [19]

Takekoshi et al.

[11] Patent Number: 5,594,538

[45] Date of Patent: Jan. 14, 1997

[54] IMAGE FORMING APPARATUS HAVING MULTI-LAYER TRANSFER MATERIAL BEARING MEMBER WITH DIFFERENT COEFFICIENT OF KINETIC FRICTIONS BETWEEN LAYERS

[75] Inventors: Nobuhiko Takekoshi, Tokyo; Masahiko Inoue, Yokohama, both of Japan

[73] Assignee: Canon Kabushiki Kaisha, Tokyo, Japan

[21] Appl. No.: 172,057

[22] Filed: Dec. 23, 1993

[30] Foreign Application Priority Data

| | | | |
|---|---|---|---|
| Dec. 29, 1992 | [JP] | Japan | 4-361019 |
| Jun. 1, 1993 | [JP] | Japan | 5-152645 |
| Jun. 1, 1993 | [JP] | Japan | 5-154501 |

[51] Int. Cl.[6] ..... G03G 15/01; G03G 15/16

[52] U.S. Cl. ..... 399/310; 399/300

[58] Field of Search ..... 355/271, 274, 355/326 R, 327, 272

[56] References Cited

U.S. PATENT DOCUMENTS

| | | | |
|---|---|---|---|
| 5,081,501 | 1/1992 | Waki et al. | 355/274 |
| 5,091,751 | 2/1992 | Inoue et al. | 355/274 |
| 5,172,172 | 12/1992 | Amemiya et al. | 355/271 |
| 5,187,536 | 2/1993 | Hasegawa et al. | 355/271 |
| 5,189,479 | 2/1993 | Matsuda et al. | 355/274 |
| 5,249,022 | 9/1993 | Watanabe et al. | 355/271 |

*Primary Examiner*—Joan H. Pendegrass

*Attorney, Agent, or Firm*—Fitzpatrick, Cella, Harper & Scinto

[57] ABSTRACT

The present invention provides an image forming apparatus comprising an image bearing means for bearing an image, a transfer material bearing member for bearing and conveying a transfer material, and a transfer member for transferring the image on the image bearing means onto the transfer material born by the transfer material bearing member, the transfer member being arranged to contact with a surface of the transfer material bearing member opposite to a surface on which the transfer material is born. The transfer member comprises a first layer contacting with the transfer material bearing member and a second layer not contacting with the transfer material bearing member, and the first layer has coefficient of kinetic friction smaller than that of the second layer.

33 Claims, 7 Drawing Sheets

IMAGE FORMING APPARATUS HAVING MULTI-LAYER TRANSFER MATERIAL BEARING MEMBER WITH DIFFERENT COEFFICIENT OF KINETIC FRICTIONS BETWEEN LAYERS

BACKGROUND OF THE INVENTION

1. Field of the Invention

The present invention relates to an image forming apparatus wherein an image on an image bearing member is transferred onto a transfer material born by a transfer material bearing member. The present invention can be applied, for example, to image forming apparatuses of electrophotographic type or electrostatic type and particularly to electrophotographic color copying machines and printers, wherein a plurality of images having different colors are formed on an image bearing member such as an electrophotographic photosensitive member and the images are successively transferred onto the same transfer material.

2. Related Background Art

In the past, there have been proposed various image forming apparatuses (so-called "color image forming apparatus") wherein toner images having different colors are formed at respective image forming portions and the toner images are successively transferred onto the same transfer material. Among them, a multi-color electrophotographic apparatus is most popular. In FIG. 10, a toner image is formed on a photosensitive member (image bearing member) 1 at each image forming portion and the toner image is transferred onto a transfer material 6 carried by a transfer belt (transfer material bearing member) 8.

With this arrangement, in order to effectively transfer the toner image formed on the image bearing member 1 such as a photosensitive drum to the transfer material 6, a regulating member for shielding or blocking the transfer electric field is often arranged upstream of the contact position between the image bearing member 1 and the transfer material bearing member 8. That is to say, in order to effect the transferring to faithfully reappear or reproduce the toner image formed on the image bearing member 1, it is necessary to regulate the transfer electric field, thereby preventing the scattering of toner (color particles forming the toner image).

To this end, a regulating member may be provided on the collotron which is usually used. However, for the most simple construction, as shown in FIG. 10, the use of a an electrode of a brush type or a plate type (particularly, plate-shaped electrode) is well known. By using such an electrode, the transfer electric field can be applied with high accuracy.

On the other hand, when the plate-shaped electrode is used, during the transferring operation, if the urging pressure between the image bearing member 1 and the transfer sheet 6 is too great, the toner image will be strongly pressed on the image bearing member 1, with the result that the toner image is not transferred to the transfer material 6 but remains on the image bearing member 1. To avoid this, when the plate-shaped electrode is used as a transfer charge means, the electrode is usually contacted with the image bearing member in a manner as shown in FIG. 10 to uniformly contact the electrode with the image bearing member with low pressure as much as possible. That is to say, the plate-shaped electrode 4 comprises a plate-shaped conductive blade (electric field applying means) 401 and an electric field regulating member 403 disposed at an upstream side of the transfer position, and a predetermined voltage is applied to the blade 401 via an electrode 402, and the blade 401 is abutted against the transfer material bearing member 8 along a shifting direction of the transfer material bearing member.

On the other hand, when a roller-shaped electrode is used as the transfer charge means, if the transfer material bearing member is urged by the electrode too strongly, a transfer void occur due to the compression of toner.

Although the urging pressure between the image bearing member 1 and the transfer material 6 can be reduced by using the above-mentioned conventional plate-shaped electrode 4, since there is the relative movement between the plate-shaped electrode 4 and the transfer material bearing member 8 contacted with the electrode, these elements are worn. Particularly, when the conductive blade 401 of the plate-shaped electrode 4 is made of resin having high coefficient ($\mu$) of friction, significant wear occurs, with the result that the abutment area between the blade and the transfer material bearing member is increased and the abutment area is shifted toward the upstream side, thereby causing the discharging phenomenon. Since the blade is made of conductive material, if the blade is worn, the conductive powder will be adhered to other electrodes, substrates, or wirings, thereby causing the discharging phenomenon, current leak or the like.

On the other hand, if the blade is made of a hard material such as metal to reduce the wear of the blade, the transfer material bearing member or the image bearing member will be damaged when the transfer charge means is contacted with the transfer material bearing member. This may happen when in the inoperative condition such as the case where the transfer material jammed due to the poor feeding is removed, the apparatus is assembled or the interior of the apparatus is cleaned, and also, for example, may happen in the case where the apparatus is designed so that the transfer charge means can be separated from the transfer material bearing member in order to release the urging force between the image bearing member and the transfer material bearing member, for preventing the transferring of the residual charges to the image bearing member, for preventing the undesirable friction between the image bearing member and the transfer material bearing member and/or for controlling the detection of the density of toner on the image bearing member.

Further, in the arrangement as shown in FIG. 10, since the urging force depends upon the elastic force of the conductive blade 401, the fatigue and creep of the blade 401 and the cure of the rubber and resin make it difficult to maintain the stable urging force. In addition, since the transfer charge means 4 is directly contacted with the transfer material bearing member to apply the transfer electric field, the dust such as the scattered toner and paper powder is accumulated to cause the transfer unevenness, thereby making the transfer efficiency uneven.

SUMMARY OF THE INVENTION

An object of the present invention is to provide an image forming apparatus wherein a proper pressure on a transfer material bearing member is stably maintained by a transfer means during a transfer operation.

Another object of the present invention is to provide an image forming apparatus which can extend the service lives of a transfer material bearing member and a transfer charge means.

A further object of the present invention is to provide an image forming apparatus which can prevent the transfer efficiency from becoming uneven.

The other objects and features will be apparent from the following explanation referring to the accompanying drawings.

DETAILED DESCRIPTION OF THE PREFERRED EMBODIMENTS

The present invention will now be explained in connection with embodiments thereof with reference to the accompanying drawings.

Figure 9:
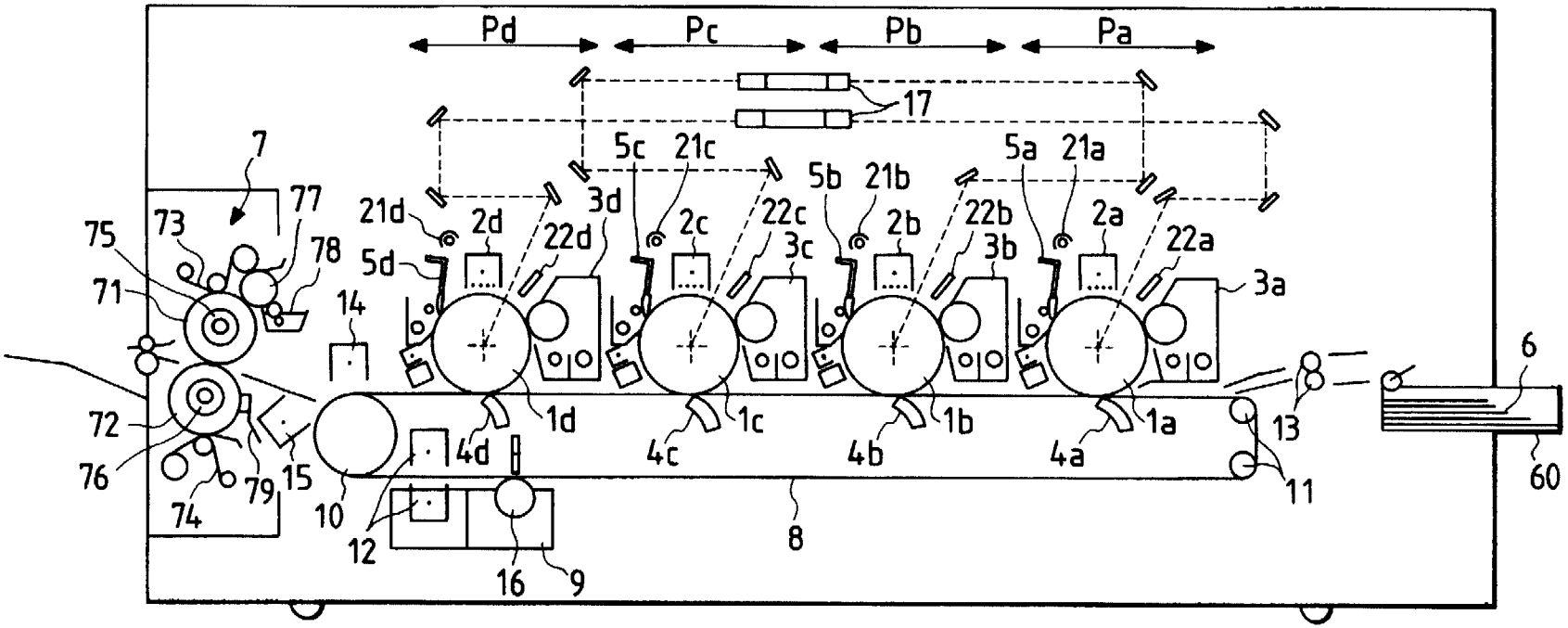
FIG. 9 is a sectional view of an image forming apparatus as which the present invention can be embodied.
Figure 10:
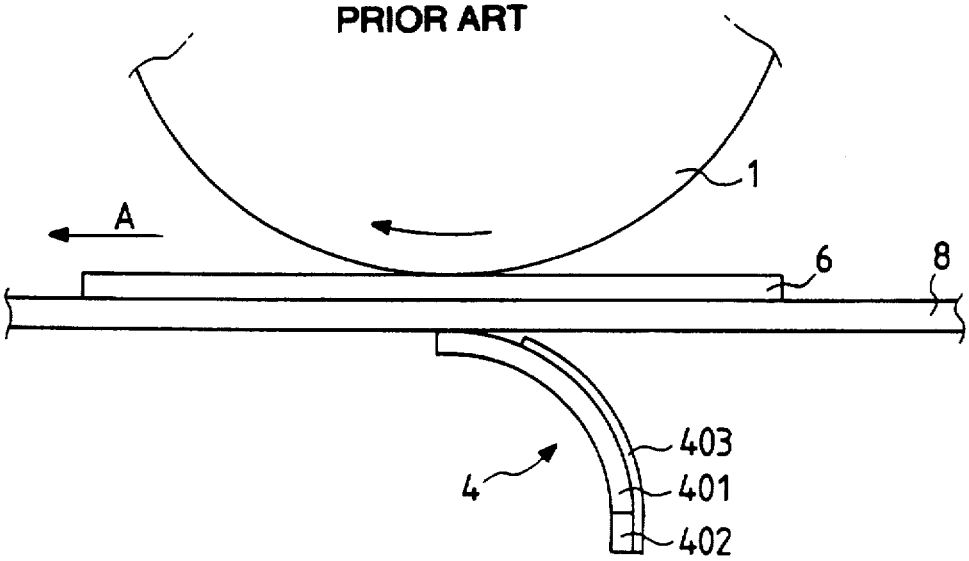
FIG. 10 PRIOR ART
FIG. 10 is a partial sectional view of a conventional transfer charge means.
Figure 11:
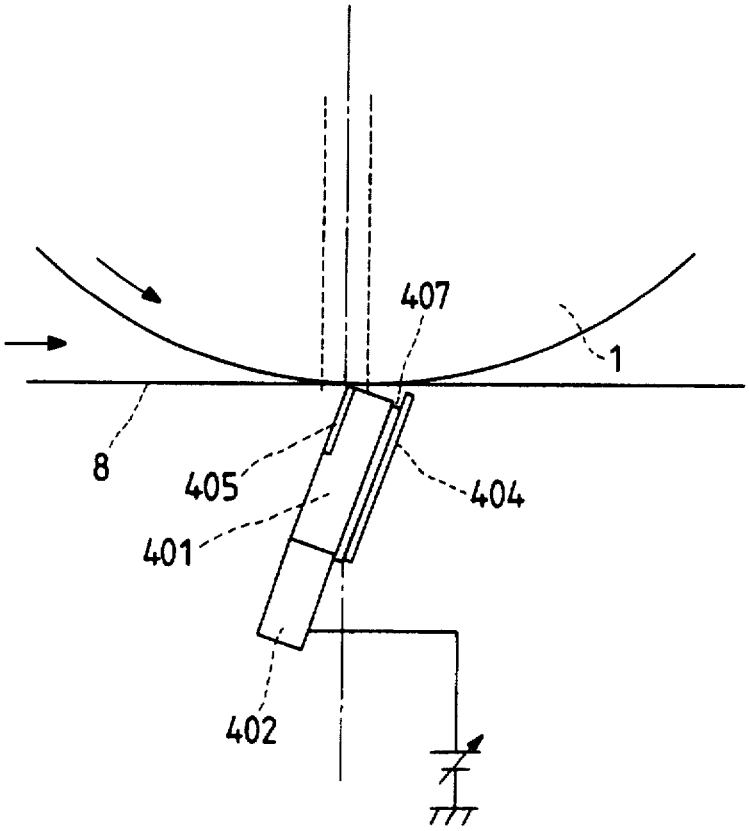

FIG. 9 is a sectional view of a color electrophotographic apparatus serving as an image forming apparatus of the present invention. The color electrophotographic apparatus includes first, second, third and fourth image forming portions Pa, Pb, Pc and Pd, where images having different colors are formed by a latent image forming process, a developing process and a transfer process. More particularly, the image forming portions Pa, Pb, Pc and Pd include exclusive image bearing members (electrophotographic photosensitive drums, in the illustrated embodiment) 1*a*, 1*b*, 1*c* and 1*d*, and toner images formed on the respective electrophotographic photosensitive drums 1*a*, 1*b*, 1*c* and 1*d* at the respective image forming portions Pa, Pb, Pc and Pd are successively transferred onto a transfer material 6 conveyed and born by a transfer material bearing member 8 shifted adjacent and along the image forming portions. Then, the toner images transferred to the transfer material 6 is fixed to the transfer material at a fixing portion 7 with heat and pressure, and then, the transfer material is discharged out of the apparatus as an imaged copy.

More concretely, around the photosensitive drums 1*a*, 1*b*, 1*c* and 1*d*, there are arranged exposure lamps 21*a*, 21*b*, 21*c* and 21*d*, drum chargers 2*a*, 2*b*, 2*c* and 2*d*, a light source (not shown), polygon mirror 17 for scanning the light emitted from the light source, and potential sensors 22*a*, 22*b*, 22*c* and 22*d*, respectively. The laser beam emitted from the light source is sent to the photosensitive drums 1*a*, 1*b*, 1*c* and 1*d*, via the polygon mirror 17 and fθ lenses (not shown), thereby forming latent images on the photosensitive drums in response to an image signal.

The latent images formed on the photosensitive drums are developed by developing devices 3*a*, 3*b*, 3*c* and 3*d* containing cyan color toner (developer), magenta color toner, yellow color toner and-black color toner, respectively, as toner images. The toner images are transferred onto the transfer material 6 supplied from a transfer material cassette 60 to the transfer material bearing member 8 through a pair of resist rollers 13 and conveyed through the image forming portions by the transfer material bearing member 8.

In the illustrated embodiment, the transfer material bearing member 8 is formed from a dielectric resin film such as a polyethylene terephthalate resin film sheet (PET sheet), a polyvinylidene fluoride resin film sheet or a polyurethane resin film sheet, and is in the form of an endless belt obtained by overlapping both ends of the film sheet and bonding the ends together or by forming it as a seamless belt.

When the transfer material bearing member 8 starts to be rotated, the transfer material 6 fed out from the transfer material cassette 60 is supplied from the pair of regist rollers 13 onto the transfer material bearing member 8. At this point, an image record signal is emitted, with the result that the image is formed on the first photosensitive drum 1*a* at a certain timing to form the toner image. This toner image is transferred onto the transfer material by the electric field or charge applying action of the transfer charge means 4*a*. In this case, the transfer material 6 is being held on the transfer material bearing member 8 by the electrostatic absorbing force. In this condition, the transfer material is conveyed to the second, third and fourth image forming portions 1*b*, 1*c*, 1*d* successively, where the respective toner images are transferred onto the transfer material successively. The transfer material 6 to which the toner images were transferred from the first to fourth image forming portions is sent to a separation charger 14 and a peel charger 15, where the electricity on the transfer material is removed to greatly reduce the electrostatic absorbing force and the transfer material is separated from the transfer material bearing member 8. Then, the transfer material is sent to the fixing portion 7.

The fixing portion 7 includes a fixing roller 71, a pressure roller 72, heat resisting cleaning members 73, 74 for cleaning the rollers, heaters 75, 76 for heating the rollers, an oil applying roller 77 for applying parting agent oil such as dimethyl silicone and the like to the fixing roller, an oil reservoir 78 for supplying the parting agent oil, and a thermistor 79 for controlling the fixing temperature. The fixing portion 7 serves to obtain a fixed image by heating and pressurizing the four color superimposed toner images on the transfer material at a nip between the fixing roller 71 and the pressure roller 72 to fuse the toner and mix the colors.

After the transferring, the residual toners (developers) remaining on the photosensitive drums 1*a*, 1*b*, 1*c* and 1*d* are removed by photosensitive drum cleaning portions 5*a*, 5*b*, 5*c* and 5*d*, respectively, thereby preparing for the next image formation. On the other hand, the developer remaining on the transfer material bearing member 8 is sent to a belt electricity removal charger 12, where the electricity is removed to greatly reduce the electrostatic absorbing force. Thereafter, at a belt cleaning portion 9, the residual developer is removed from the transfer material bearing member by a fur brush 16 rotated at a speed different from that of the transfer material bearing member. The belt cleaning means may comprise a blade, a non-woven cloth element or combination thereof, in place of the fur brush.

Figure 1:
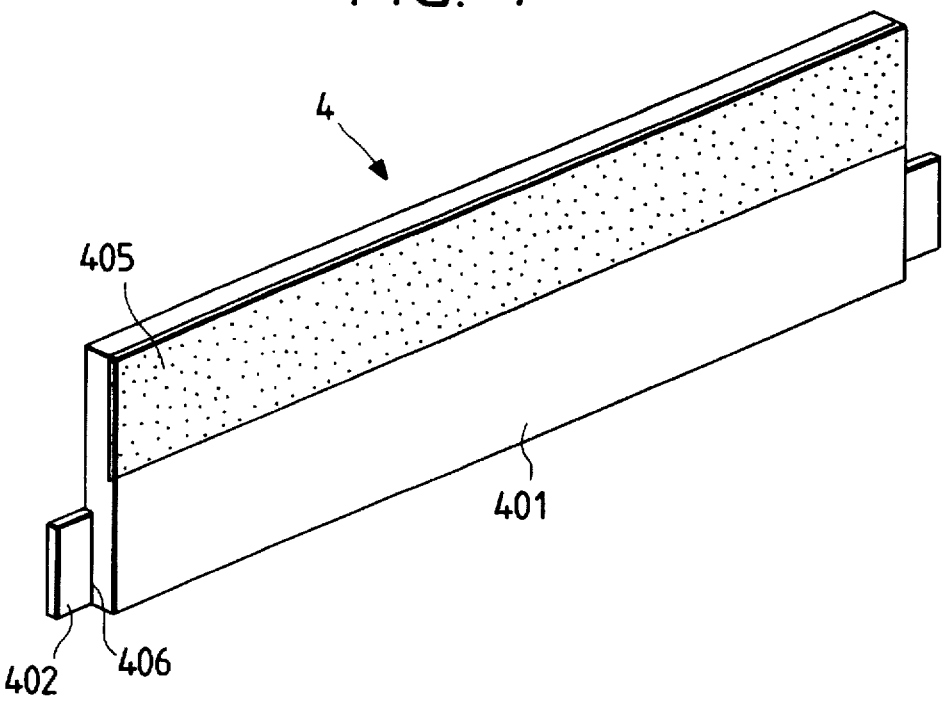
FIG. 1 is a perspective view of a transfer charge means usable in an image forming apparatus according to the present invention.

FIG. 1 is a perspective view of a transfer charge means 4 which can be applied to the apparatus of FIG. 9. According to this embodiment, the transfer charge means, i.e., electric field applying means 4 comprises a conductive layer 401 comprised of a rectangular plate-shaped conductive rubber member extending in a direction (referred to as "thrust direction" hereinafter) perpendicular to a transfer material convey direction (to which the transfer material is conveyed by the transfer material bearing member), a high conductive electrode 402 joined to the conductive layer 401 by conductive bonding agent 406 so that the voltage can be uniformly applied to the conductive layer 401 in the thrust direction. In the transferring operation, a DC voltage having a polarity opposite to that of the toner is applied to the electrode 402 from a power source.

Further, according to this embodiment, an abutment layer 405 having a coefficient (μ) of kinetic friction lower than that of the material constituting the conductive layer 401 is coated on a surface of the conductive layer 401 which is opposed to the transfer material bearing member 8. Further, the transfer charge means is supported by a support member (not shown) at the electrode 402.

Figure 2:
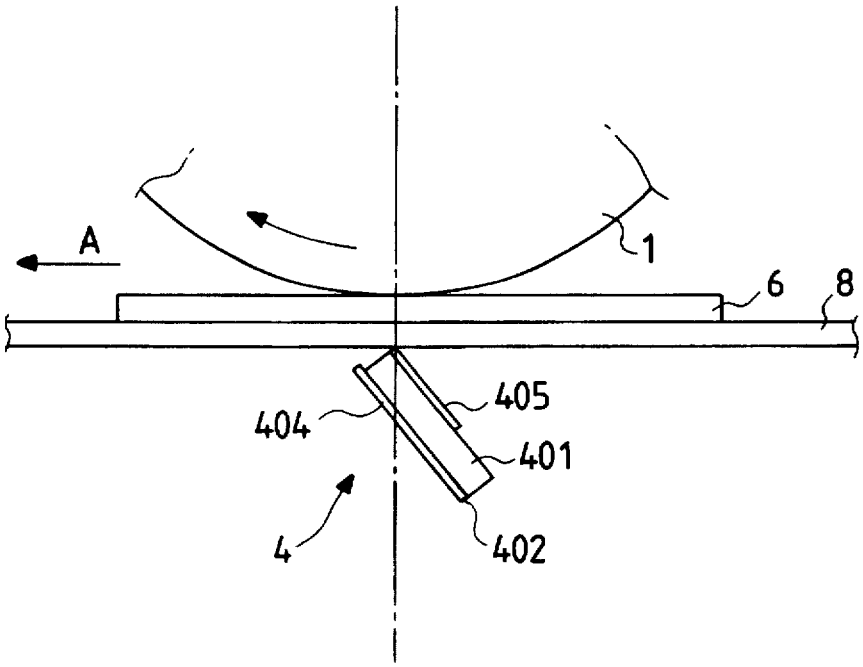
FIG. 2 is a partial sectional view of a transfer position or therearound of the transfer charge means of FIG. 1.

Furthermore, as shown in FIG. 2, an urging member 404 formed from a plate-shaped or film-shaped elastic body is provided on a surface of the electric field applying member (constituted by the electrode 402, conductive layer 401 and abutment layer 405) which is opposite to a surface of the conductive layer 401 on which the abutment layer 405 is disposed, thereby obtaining the urging force which is uniform in the thrust direction and which is optimum regarding the transferring.

In this embodiment, while the discrete urging member 404 was provided as a part of the transfer charge means 4 in order to make the urging force more uniform, such urging force may be obtained by utilizing the elasticity of the conductive layer 401, abutment layer 405 and/or electrode 402 constituting the electric field applying member.

As mentioned above, in the transfer charge means 4 having either of the above-mentioned constructions, the conductive layer 401 is generally obtained by mixing or blending carbon black or other conductive filler to isoprene rubber, styrene rubber, nitrile rubber, butyl rubber, chlorosulfuric polyethylene, acrylic rubber, silicone rubber, SBR (styrene butadiene rubber), BR (butadiene rubber), EPDM (ethylene propylene diene tri-copolymer), urethane rubber, chloroprene rubber, epichlorohydrin rubber, polyvulcanized rubber, fluororubber or thier synthetic rubber, or synthetic resin such as nylon, urethane, polyester or the like. The hardness thereof is preferably in a range of JIS A 40° to 80°. The conductive filler may be tin oxide. In this case, generally, the conductive layer is a soft one when the urging member 404 is used as shown in FIG. 2, and is a hard one when the urging force is maintained by the elasticity of the conductive layer 401. Further, the electric resistance is selected to $10^2$ to $10^8$ Ω. cm (volumetric specific resistance), and a thickness is selected so that the transfer charge means can be abutted against the transfer material bearing member 8 in an area smaller than a width (referred to as "nip portion" hereinafter) that the image bearing member 1 is abutted against the transfer material 6; and, preferably, the thickness is selected to about 1 mm in consideration of the durability, operability and cost.

On the other hand, the abutment layer 405 may be formed from fluororesin such as PTFE, PFa or the like, or engineering plastics such as polyurethane elastomer, graphite fluoride, polycarbonate resin or the like, or other surface altering materials for obtaining low friction.

As mentioned above, the purpose for providing the abutment layer 405 is to prevent the wear of the conductive layer 401, to prevent the contamination due to the toner fusing and to optimize the electric resistance and contact resistance for applying the proper electric field at the abutment. By making the abutment layer 405 from dielectric material, it is possible to regulate the electric field at the upstream side in the convey direction during the transferring operation.

However, in order to achieve these objects, it is necessary that the abutment layer 405 have the coefficient of friction smaller than that of the conductive layer 401 and the volumetric specific resistance greater than the conductive layer. Accordingly, any combination of the above materials can not necessarily be used to cause the transfer charge means 4 to function as the electric field applying means. Thus, impedance R (=V/I) sought from the apply current I and apply voltage V when the electric field applying member constituted by the conductive layer 401 and the abutment layer 405 is used as the transfer charge means 4 should not be greater than impedance $R_T$ obtained by subtracting impedance $R_0$ of the transfer charge means itself, i.e., the electric field applying member itself by $10^2$ order or more.

The impedance $R_T$ is impedance of the transfer material bearing member 8, transfer material 6, toner and image bearing member 1, and gaps created when these elements are contacted, and can be measured by making the electric field applying member as metal. On the other hand, if the impedance R is greater than $10^2$ R, since the apply voltage becomes too great, the discharging phenomenon will be caused, thereby scattering the toner particles forming the toner image to deteriorate the image. Further, as shown in FIG. 9, when the toner particles having different colors are successively transferred in a superposed fashion, the impedance is increased by the charges accumulated on the transfer material bearing member 8 and the transfer material 6, with the result that, since the apply voltage for the fourth color is more increased, the scattering of toner is apt to be caused by the discharge of the toner particles. Thus, in order to clearly transfer and reproduce the multi-color transferred image, $R_O$ ($R \approx R_T$) is preferably made or small as possible. However, if the electric field applying member is formed from low resistive material such as metal, it is known to generate the image drawback such as the charge unevenness. Thus, the electric field applying member is made of material having $10^2$ Ω or more.

Figure 3:
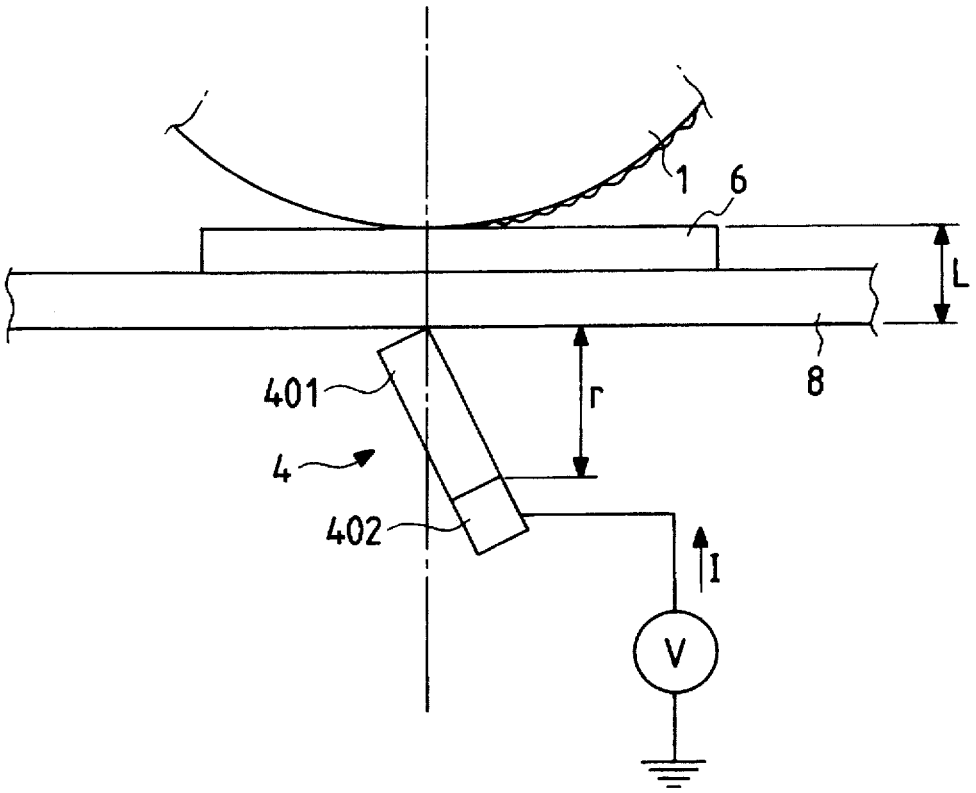
FIG. 3 is a partial sectional view for explaining an operation of the transfer charge means according to the present invention.
Figure 4:
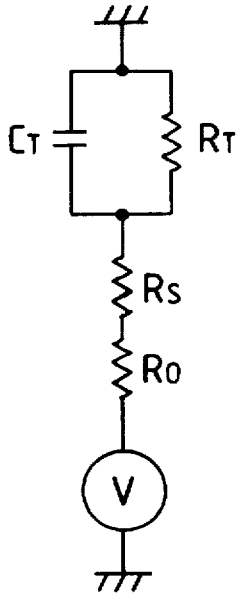
FIG. 4 is an equivalent circuit view for explaining an operation of the transfer charge means according to the present invention.

The above relation will briefly be explained with reference to FIGS. 3 and 4. FIG. 3 shows a condition that the electric field applying member 4 is contacted with the image bearing member 1 via the transfer material bearing member 8 and the transfer material 6 as shown in FIG. 1. Now, it is assumed that a distance from the image bearing member 1 to the back surface of the transfer material bearing member 8 through the toner layer and the transfer material 6 is L, and a distance between the back surface of the transfer material bearing member and the electrode 402 of the electric field applying member 4 is r. Further, in FIG. 4 schematically shows a high voltage source V for applying the electric field and a condition that there is contact resistance $R_S$ between the transfer impedance $R_T$ and the electric field applying member impedance $R_O$. By the way, there is a problem of the dielectric breakdown (the discharging phenomenon is caused if a predetermined distance is not maintained from the apply voltage V (kv)).

First of all, the case where the resistance $R_O$ of the electric field applying member 4 is small in comparison with the contact resistance $R_S$ is considered. In this case, the contact resistance $R_S$ is varied in dependence upon the contacting condition between two elements relatively moved and the potential difference between these elements, and is Generally in a range of $10^0$ to $10^2$ (Ω). Now, when the contact distance is r (mm), since $r_T \leqq 0$ and since the current I has the transfer impedance of $10^8$ to $10^9$ (Ω) and the apply voltage is 1 to 10 (kV) (i.e., $R_S \leqq R_T$, $V_S \leqq V$), the voltage (kV) outputted from the voltage source V does not follow the fluctuation of $R_S$, and, accordingly, if a given current I is used, the local discharge phenomenon will occur. Therefore, by using the electric field applying member 4 having the resistance $R_O$ smaller than the contact resistance $R_S$, the Good image cannot be obtained.

Next, the case where the resistance $R_O$ is greater than the contact resistance $R_S$ is considered. From FIG. 4, the apply voltage V ($=V_T+V_S+V_O$) is applied to the resistances ($R_T+R_S+R_O$) and a distance therebetween is (r+L)(mm). Since the transfer material 6 is generally a paper sheet having a thickness of about $5\times10^{-2}$ to $5\times10^{-1}$ (mm) and the transfer material bearing member 8 is usually formed from a dielectric film sheet having a thickness of about $5\times10^{-2}$ to $5\times10^{-1}$ (mm) in consideration of the handling strength and electrostatic capacity and the toner particle layer has a thickness of about $10^{-2}$ order (mm), the distance L becomes about $10^{-1}$ to $10^0$ order(mm).

Further, since the apply voltage for the fourth color in the multi transferring is generally about 10–1 kV, in consideration of $V_S=10^0$ to $10^2$ (Ω), the apply voltage can be represented as $V=V_T+V_O$. Considering the dielectric breakdown, although $V_O$ has the order which is negligible with respect to $V_T$, since the apply voltage V of 1 to 10 (kV) is applied and the distance L is smaller than 1 (mm) regarding the distance r+L, the distance r between the electrode 402 and the transfer material bearing member 8 must be greater than $10^0$ to $10^1$ (mm) depending upon the apply voltage V. The critical value is determined by the apply voltage V. Too short (too thin) material is unsuitable. In this way, in case of the electric field applying member having the resistance value $R_O$ satisfying the relation $R_S \leqq R_O \leqq R_T$, the good image can be obtained.

Next, in case of $V_T < V_O$ or in case where even when $R_O$ is small in comparison with the above $R_S$, $R_S$ is greater than the above case and $V_S$ becomes great, the apply voltage V is not governed by $V_T$, but governed by $V_O$ or $V_S$. In this case, regarding $R_S > R_O$, contrary to the case where the discharge is caused between $R_S$, since the transfer current I is governed and controlled by the fluctuation of $R_S$ or $R_O$, depending upon the transfer condition (for example, the change in the electric capacity and electric resistance of the transfer material and the like), not only the control for applying the optimum transfer current cannot be effected but also the discharge is caused between the transfer material bearing member 8 and the image bearing member 1 (distance L) or between the transfer material 6 and the image bearing member 1, thereby making the transfer system unsuitable.

Incidentally, the above-mentioned control of current and voltage corresponds to the constant current or constant voltage control between (r+L) which is usually used.

In the illustrated embodiment, PVdF sheet having a thickness of 150 μm was used as the transfer material bearing member 8, the transfer current I was 12 μA and the apply voltage V was 2 kV (for first color), 2.7 kV (for second color), 3.2 kV (for third color) and 3.4 kV (for fourth color). Further, the electric field applying member 4 had the construction as shown in FIG. 1, where the conductive layer 401 was formed from EPDM conductive rubber blade having a thickness of 1 mm, the resistance thereof $R_O$ was about $10^6$ Ω (surface specific resistance of $10^8$ Ω/□), and the distance r was 15 mm. Further, the abutment layer 405 was made of graphite fluoride coated by Sefvon-CMA (trade mark; manufactured by Central Glass Co. in Japan). With this arrangement, a good result could be obtained.

Figure 5:
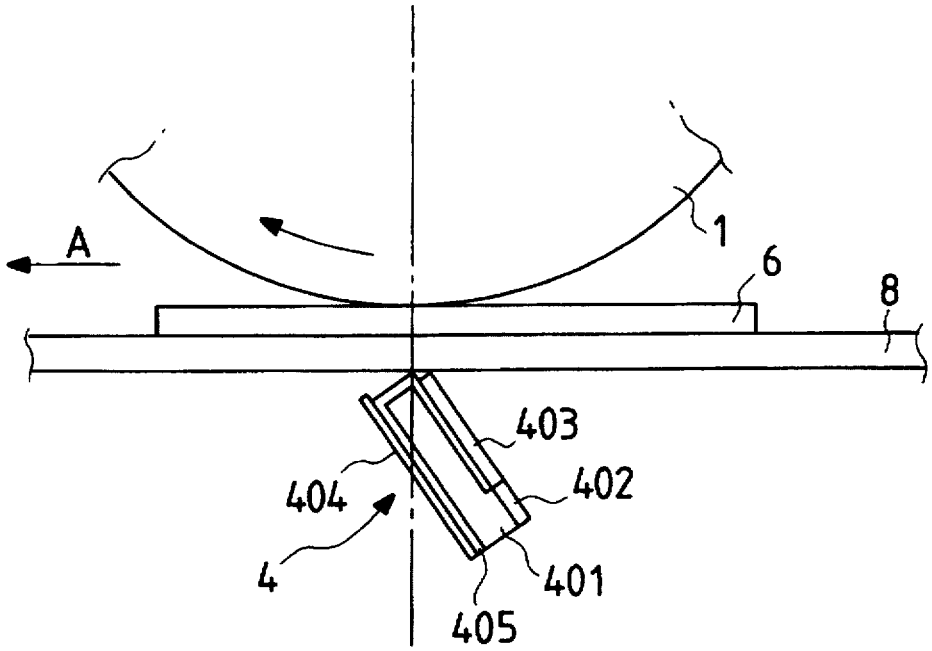
FIGS. 5, 6 and 7 are partial sectional views of a transfer charge means according to another embodiment of the present invention.

In the transfer charge means, in order to obtain the good image, a technique in which the scattering of toner is suppressed by regulating the transfer electric field in a narrow area has been proposed. In FIG. 5, an embodiment using a transfer charge means 4 having an electric field regulating member is shown.

According to this embodiment, similar to the aforementioned embodiment, the transfer charge means, i.e., the electric field applying member 4 comprises a conductive layer 401 formed from rectangular plate-shaped conductive rubber, and an electrode 402 jointed to the conductive layer 401. Further, an abutment layer 405 is provided on a surface through which the transfer material bearing member 8 is contacted with the electric field applying member 4. As shown, the abutment layer 405 may be provided to enclose not only the surface including the nip portion but also the conductive layer 401.

Further, according to this embodiment, an electric field regulating member 403 is provided on the electric field applying member 4. The electric field regulating member 403 is formed from thin (for example, about 50 μm) dielectric film made of PET (polyethylene terephthalate). The PET film 403 is adhered to a surface of the conductive layer 401 opposite to the surface on which an urging member 404 is provided.

Figure 6:
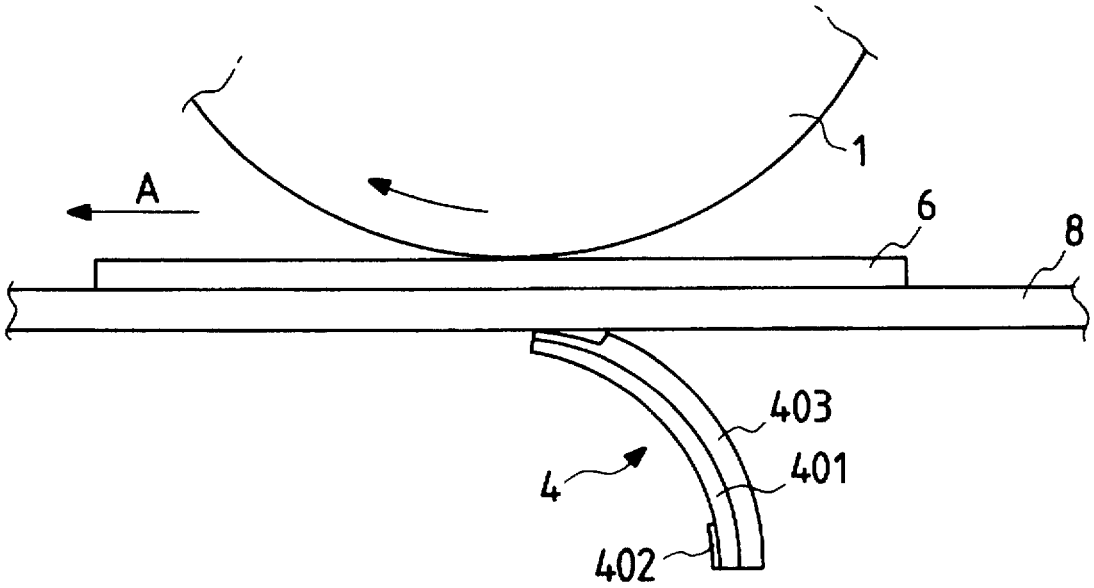

FIG. 6 shows an alteration of the transfer charge means 4 wherein an abutment layer and an electric field regulating member are integrally formed as a layer 403.

According to this alteration, the electric field regulating member 403 also acts as the abutment layer, and the electric field regulating member 403 is provided at its free end with a step so that a thinner portion of the step acts as the abutment layer contacting with the transfer material bearing member 8. The electric field regulating member 403 can be formed from PTFE sheet, for example, and the thinner portion has a thickness of 30 μm and the other portion has a thickness of 50 μm. By using such transfer charge means 4, the same technical effect as the aforementioned embodiment can be achieved.

In the above embodiments, while the blade-shaped electric field applying members 4 were explained, the present invention is not limited to such shape.

Figure 7:
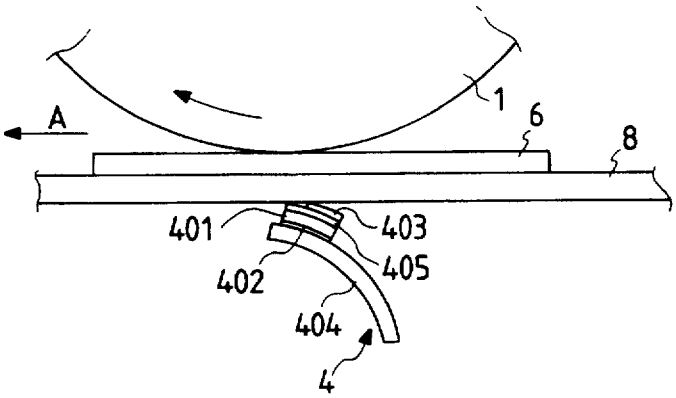

FIG. 7 shows another alteration of the transfer charge means 4. In this alteration, the transfer charge means, i.e., the electric field applying member 4 comprises a conductive layer 401 and an abutment layer 405. Further, the electric field applying member is provided with a step so that the abutment layer 405 is abutted against the transfer material bearing member 8, and an electric field regulating member 403 is laminated on the abutment layer 405. Further, an electrode 402 is bonded, by a conductive adhesive, to a surface of the conductive layer 401 opposite to the surface on which the abutment layer 405 is provided. Further, similar to the electrode 402 shown in FIG. 1, the conductive layer 401 and the electrode 402 have configurations which are short in the thrust direction. Accordingly, it is possible to suppress the fluctuation due to the elastic deformation of the conductive layer 401.

The electric field applying member 4 of chip type constructed as mentioned above is bonded to a free end of an urging member 404 so that it can be urged against the image bearing member 1 via the transfer material 6 and the transfer material bearing member 8. In order to prevent the change in the urging force of the urging member 404, the urging member 404 is preferably be formed from ABS or phenol resin rather than PET film or polycarbonate film. Further, preferably, the urging member is biased by a spring or the like.

By using the transfer charge means 4 having the chip-shaped electric field regulating member according to this alteration, the same technical effect as those in the above-mentioned embodiment can be achieved.

In the above-mentioned embodiments, while an example that the image forming apparatus has a plurality of image bearing members 1 and the transfer material 6 is conveyed by the belt-shaped transfer material bearing member 8 and the images are transferred onto the transfer material was explained, the present invention is not limited to such example.

Figure 8:
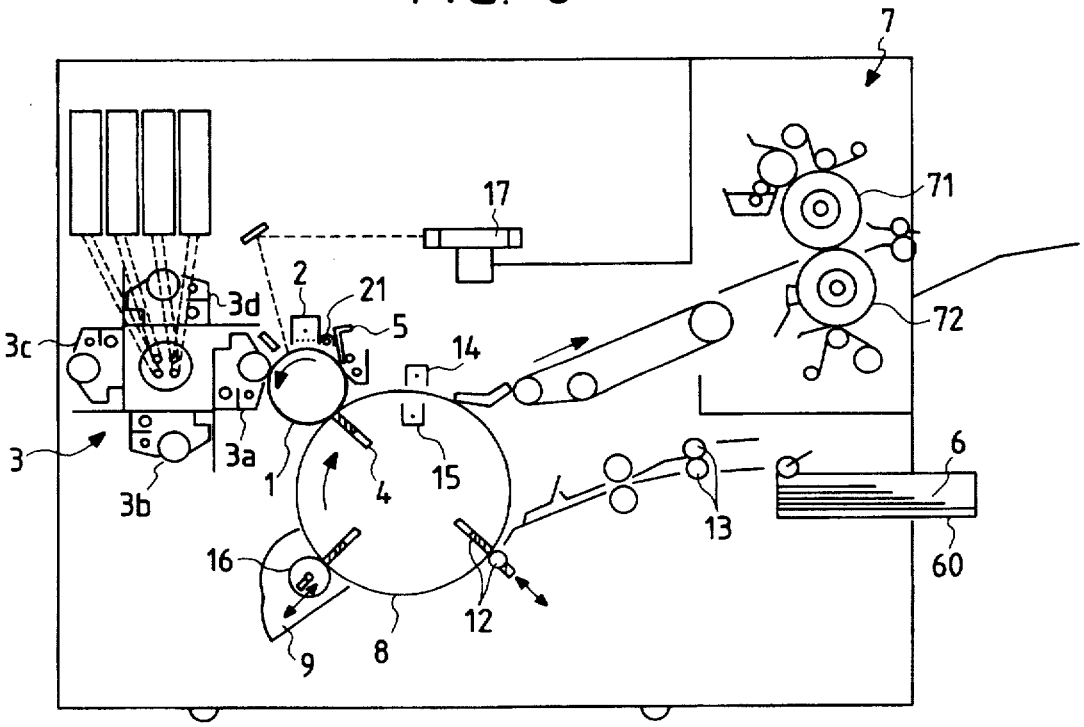
FIG. 8 is a sectional view of an image forming apparatus according to an embodiment of the present invention.

FIG. 8 shows an electrophotographic color recording apparatus as an example of another image forming apparatus to which the present invention can be applied. This electrophotographic color recording apparatus according to this embodiment has a single image forming portion.

That is to say, around an electrophotographic photosensitive drum (image bearing member) 1, there are arranged an exposure lamp 21, a first charger 2, a light source (not shown), and a polygon mirror 17 for scanning the light emitted from the light source. The laser beam emitted from the light source is sent to the photosensitive drum 1 through the polygon mirror 17 and an fθ lens (not shown), thereby forming a latent image on the drum 1 in response to an image signal.

A developing apparatus 3 for developing the latent image as a toner image is of rotatable type in which an yellow developing device 3*a*, a magenta developing device 3*b*, a cyan developing device 3*c* and a black developing device 3*d* are mounted on a rotatable table. The developing devices 3*a*, 3*b*, 3*c* and 3*d* contain predetermined amounts of yellow developer, magenta developer, cyan developer and black developer, respectively, so that the color toner image is formed on the photosensitive drum 1 depending upon the latent image.

On the other hand, a transfer material 6 fed out from a transfer material cassette 60 is supplied to a transfer material bearing member 8 though a pair of regist rollers 13. In this embodiment, the transfer material bearing member 8 comprises a transfer drum around which a transfer sheet formed from a dielectric resin sheet such as polyethylene terephthalate resin film sheet (PET sheet), polyvinylidene fluoride resin film sheet or polyurethane resin film sheet is wounded.

Next, an operation of this color image forming apparatus will be explained in connection with the case where an image is formed with four colors. The photosensitive drum rotating in a direction shown by the arrow is uniformly charged by the first charger 2, and then, the image exposure is effected by the laser beam modulated by an image signal corresponding to yellow portions of an original, thereby forming an electrostatic latent image on the photosensitive drum 1. This latent image is developed by the yellow developing device 3*a* previously positioned at a predetermined position, thereby obtaining a toner image.

On the other hand, the transfer material 6 supplied from the transfer material cassette 60 and conveyed through a sheet supply roller and sheet supply guides is pushed out in a direction along the transfer drum 8. In this case, the transfer material 6 is urged against the transfer drum 8 by an absorb roller 12 and at the same time the transfer material is electrostatically born on the transfer drum 8 by the action of an absorb charger 12 opposed to the drum. The transfer drum 8 is rotated in a direction shown by the arrow in synchronous with the rotation of the photosensitive drum 1, and the toner image developed by the yellow developing device 3*a* is transferred onto the transfer material by a transfer charge means 4 at a 10 transfer position. The transfer drum 8 continues to rotate for preparation for the next color (for example, magenta) image transferring.

On the other hand, the photosensitive drum 1 is cleaned by a cleaning member 5, and is again charged by the charger 2. Then, the similar latent image as explained above is formed in response to a magenta image signal. During this, the developing apparatus 3 is rotated to bring the magenta developing device 3*b* to the predetermined position. In this way, the predetermined magenta development is effected. Then, by repeating the above-mentioned operations with respect to cyan color and black color, four visualized color images are formed on the transfer material 6. After this process, the transfer material 6 is separated from the transfer drum 8 by a separation pawl, and then is sent to a fixing portion 7 by a convey belt and the like.

The fixing portion 7 includes a fixing roller 71, a pressure roller 72 and the like, and serves to fix the toner images on the transfer material with heat and pressure. After the electricity of the residual developer remaining on the transfer drum 8 is removed by electricity removal chargers 14, 15, the residual developer is removed from the drum by a rotatable fur brush 16 provided in a cleaning device 9.

By arranging the transfer charge means 4 having the above-mentioned construction in the transfer position of the apparatus of FIG. 8, the same technical effect can be obtained.

Next, preferred hardness of the element 401 shown in FIGS. 1 and 2 will be explained.

If the hardness of the conductive layer 401 is increased, even when there is the dielectric sheet such as the transfer material bearing member 8, the abutment accuracy is decreased, thereby facilitating the occurrence of the charge unevenness. To solve this problem, the inventors performed the following tests regarding the hardness of the conductive layer. That is to say, carbon black as conductive filler was mixed to epichlorohydrin rubber, thereby preparing five kinds of test pieces each having the surface resistance value of $10^9$ Ω/□ and having hardnesses (JIS A type) of 50°, 60°, 70°, 80° and 90°, respectively. For each test piece, a coating layer having a thickness of 15 μm and obtained by dispersing carbon fluoride powder into nylon was provided as an upper layer, thereby obtaining the transfer charge members 4 as shown in FIG. 1. Then, each transfer charge member 4 was used in the image forming apparatus shown in FIG. 9 and the apparatus was operated under the condition of temperature of 23° C. and humidity of 5%. As a result, it was found that the good transferred images could be obtained up to the hardness 60°, but that, as the hardness was increased to 70°, 80° and the like, stripes were formed in the image due to the stripe-shaped charge unevenness. Further, under the condition of temperature of 23° C. and humidity of 60%, the good images could be obtained by using the test pieces having the hardness of 50° to 80°, but in the transfer charge member having the hardness of 90°, the scratches were formed in the element to be charged.

Further, it was found that, if the urging force of the transfer charge member against the image bearing member is too strong, when 2 to 4 line images are transferred, transfer void (phenomenon that the toner in the line image is not transferred from the image bearing member) is apt to be caused particularly in the line images extending in the transfer material conveying direction. To the contrary, in order to reduce the urging force as much as possible, it was effective to use the low hardness.

However, when zinc oxide was mixed to hydrin rubber, thereby preparing test pieces 401 having hardnesses (JIS A type) of 35°, 40° and 50°, respectively, and, for each test piece, the above-mentioned coating layer 405 was provided, thereby obtaining the transfer charge members, and these members were used for a month under the condition of temperature of 30° C. and humidity of 80%, it was found that the transfer charge member having the hardness of 35° causes a deviation of the abutment position, thereby generating the poor image. Further, the transfer charge members 4 were manufactured by coating the above-mentioned upper layers 405 on substrates obtained by mixing carbon black into EPDM and silicone rubber, respectively. When such transfer charge members were tested in the above-mentioned manner, the same conclusion was obtained regarding the hardness.

Incidentally, the urging members 404 used in the above tests were formed from phenol resin having a thickness of 1 mm and had a thrust width of 300 mm, a thickness of 1.5 mm and a height of 30 mm.

From the above test results, it was found that, in the transfer means acting through the transfer material bearing member 8 of dielectric film, although the good transferred image can be obtained when the hardness (JIS A type) of the substrate (conductive layer) is smaller than 80°, in consideration of the environmental stability and the durability, the hardness is more preferably 40° to 60°. Incidentally, the surface specific resistance of the substrate is preferable $10^2$ to $10^{10}$ Ω/□.

Next, among the above transfer charge members 4, particularly in the transfer charge member 4 including the substrate 401 having the hardness of 60°, the tests were performed regarding the upper layer 405 (by providing no upper layer and by increasing the thickness of the upper layer gradually). As a result, in the transfer charge member having no upper layer, both rubber materials were worn for 1000 revolutions and the abutment width was increased.

Further, during the application of the transfer electric field, when the constant current control of 10 μA (proper transfer zone) was effected, it was found that as the thickness of the upper layer 405 is increased the apply voltage should be increased accordingly. However, when the thickness of the layer exceeded 100 μm, the discharge occurred, thereby generating the poor image. Further, when Trezin (trade mark) layer having a thickness of 30 μm was coated on the upper layer 405, it was found that the coefficient of friction is increased, the rotational load of the transfer material bearing member is increased and the conveying ability for the transfer material and the poor image are caused, particularly in the high humidity condition.

In consideration of the above, when a coating layer having a thickness of about 15 μm and obtained by dispersing graphite fluoride (fluorocarbon) powder into high molecular resin (such as nylon) solution and by dipping and then by drying, heating and curing was provided on the upper layer 405, it was greatly effective to avoid the above problem.

The graphite fluoride used in this embodiment may be, for example, Sefvon DM of (C2F)n type (manufactured by Central Glass Co.), Sefvon CMA of (CF)n type and Sefvon DMF of (CF)n type (manufactured by Central Glass Co.), carbon fluoride #2065, #1030, #1000 (manufactured by Asahi Glass Co.), CF-100 (manufactured by Japan Carbon), carbon fluoride #2028, #2010 of (CF)n type having modified fluoro-rate (manufactured by Asahi Glass Co.), or may be obtained by treating graphite fluoride by base such as amine to remove fluorine from the surface. However, the graphite fluoride is not limited to these examples. Further, in order to more improve the abutment condition between the transfer material bearing member 8 and the transfer charge means 4, the average particle diameter of graphite fluoride is smaller than 20 μm and preferably is smaller than 8 μm.

As mentioned above, it was found that, as the upper layer 405, the use of fluororesin or dielectric material including fluorine powder is excellent regarding the environment adaptation and durability. Further, preferably, the upper layer 405 has the hardness greater than that of the substrate 401 and has a thickness smaller than 200 μm. In addition, the hardness of the urging member 404 is preferably greater than that of the substrate 401.

Further, in the image forming apparatus as shown in FIG. 9, when the feedback control (for forming an appropriate pattern on the image bearing member and reading the pattern by an optical sensor (not shown)) is effected in order to control the transfer charge memory for the image bearing member or to control the surface potential of the image bearing member or when the jam treatment for the transfer material is effected, the transfer charge member is often separated from the image bearing member or the transfer material bearing member.

Figure 12:
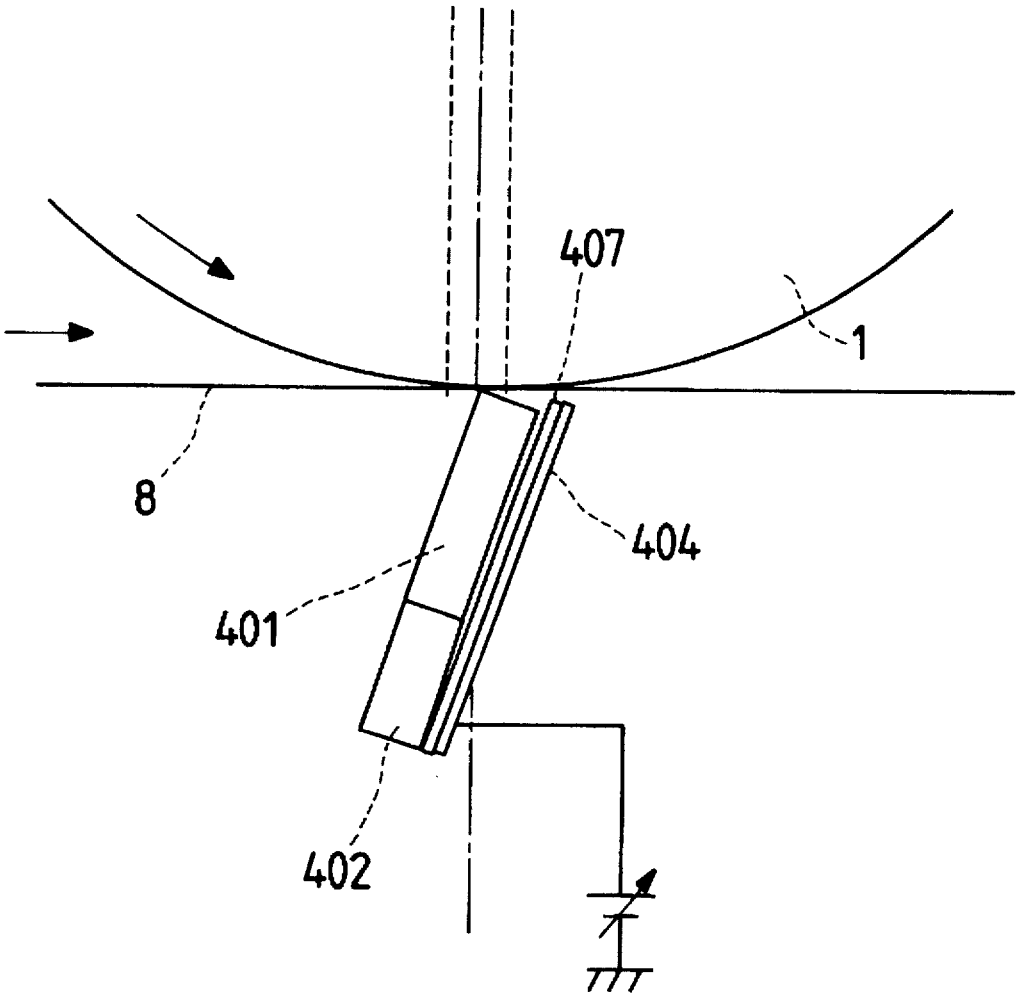
FIGS. 11 and 12 are partial sectional views of a transfer charge means which can be applied to an image forming apparatus according to the present invention.

In such a case, if the urging member for adjusting the flexion of the substrate 401 and the substrate 401 are not smoothly slid, it is possible that the further flexion becomes improper or the nip position is shifted to cause the poor transferring. To avoid such a problem, as shown in FIG. 12, it is preferable that a lubricating member 407 is arranged between the substrate 401 and the urging member 404. The lubricating member 407 may be formed from Teflon, oil paper, peel paper or other appropriate low friction material. Alternatively, silicone oil may be coated between the substrate and the urging member.

What is claimed is:

1. An image forming apparatus comprising:

an image bearing means for bearing an image;

a transfer material bearing member for bearing and conveying a transfer material; and a transfer member for transferring the image on said image bearing means onto the transfer material born by said transfer material bearing member, said transfer member being arranged to contact with a surface of said transfer material bearing member opposite to a surface on which the transfer material is born;

wherein said transfer member comprises a first layer contacting with said transfer material bearing member and a second layer not contacting with said transfer material bearing member, and wherein a coefficient of kinetic friction between the first layer and said transfer material bearing member is smaller than that between the second layer and said transfer material bearing member.

2. An image forming apparatus according to claim 1, wherein said transfer member further comprises an electrode to which a voltage is applied.

3. An image forming apparatus according to claim 2, wherein said first layer has volume specific resistance greater than that of said second layer.

4. An image forming apparatus according to claim 1, wherein said transfer member has an urging member for urging said first layer against said transfer material bearing member, and said urging member is disposed at an opposite side of said first and second layers with respect to said transfer material bearing member.

5. An image forming apparatus according to claim 4, wherein said urging member has a sheet-shape.

6. An image forming apparatus according to claim 1, wherein said transfer member has a plate-shape.

7. An image forming apparatus according to claim 1, wherein a hardness of said second layer is smaller than 80° (JIS A).

8. An image forming apparatus according to claim 1, wherein a hardness of said second layer is 40° to 60° (JIS A).

9. An image forming apparatus according to claim 1, wherein said first layer has a thickness smaller than 200 μm and a hardness (JIS A) greater than that of said second layer.

10. An image forming apparatus according to claim 1, wherein said first layer includes fluororesin.

11. An image forming apparatus according to claim 1, wherein volume specific resistance of said second layer is $10^2$ to $10^8$ Ωcm.

12. An image forming apparatus according to claim 3, wherein volume specific resistance of said second layer is $10^2$ to $10^8$ Ωcm.

13. An image forming apparatus according to claim 4, wherein said transfer member has a lubricating member positioned between said first layer and said urging member.

14. An image forming apparatus according to claim 5, wherein said transfer member has a lubricating member positioned between said first layer and said urging member.

15. An image forming apparatus according to claim 1, wherein said first layer is provided on a whole surface of said second layer opposite to a surface which faces said transfer material bearing member.

16. An image forming apparatus according to claim 1, wherein a support portion for supporting said transfer member is positioned at an upstream side of a contact portion between said transfer member and said transfer material bearing member in a transfer material shifting direction.

17. An image forming apparatus according to claim 1, wherein said image bearing means has a plurality of image bearing members for bearing images having different colors, respectively, and the images having different colors are transferred onto the transfer material born by said transfer material bearing member in a superposed fashion.

18. An image forming apparatus according to claim 1, wherein said image bearing means comprises a single image bearing member capable of bearing images having different colors, and the images having different colors are transferred onto the transfer material born by said transfer material bearing member in a superposed fashion.

19. An image forming apparatus according to claim 17, wherein the image forming apparatus can form a full-color image on the transfer material.

20. An image forming apparatus according to claim 18, wherein the image forming apparatus can form a full-color image on the transfer material.

21. An image forming apparatus according to claim 1, wherein the first layer contains a resin.

22. An image forming apparatus according to claim 7, wherein the first layer has a hardness greater than that of the second layer.

23. An image forming apparatus comprising:

an image bearing means for bearing an image;

a transfer material bearing member for bearing and conveying a transfer material;

a transfer member for transferring the image on said image bearing means onto the transfer material born by said transfer material bearing member, said transfer member being arranged to contact with a surface of said transfer material bearing member opposite to a surface on which the transfer material is born, and voltage application means for applying a voltage to said transfer member for transferring the image onto the transfer material;

wherein said transfer member has a conductive portion and a dielectric portion containing a fluorine resin and is contactable with said transfer material member only at the dielectric portion.

24. An image forming apparatus according to claim 23, wherein a volume specific resistance of the dielectric portion is greater than that of the conductive portion.

25. An image forming apparatus according to claim 24, wherein the volume specific resistance of the conductive portion is $10^2$–$10^8$ Ωcm.

26. An image forming apparatus according to claim 23, wherein said transfer member has an urging member for urging the layer against said transfer material bearing member, and said urging member is disposed at an opposite side of the dielectric layer and the conductive layer with respect to said transfer material bearing member.

27. An image forming apparatus according to claim 26, wherein said urging member has a sheet-shape.

28. An image forming apparatus according to claim 23, wherein said transfer member has a plate-shape.

29. An image forming apparatus according to claim 23, wherein the dielectric portion contains a resin.

30. An image forming apparatus according to claim 23, wherein said image bearing means has a plurality of image bearing members for bearing images having different colors, respectively, and the images having different colors are transferred onto the transfer material born by said transfer material bearing member in a superimposed fashion.

31. An image forming apparatus according to claim 30, wherein the image forming apparatus can form a full-color image on the transfer material.

32. An image forming apparatus according to claim 23, wherein said image bearing means comprises a single image bearing member capable of bearing images having different colors, wherein the images having different colors are transferred onto the transfer material born by said transfer material bearing member in a superimposed fashion.

33. An image forming apparatus according to claim 32, wherein the image forming apparatus can form a full-color image on the transfer material.

* * * * *

UNITED STATES PATENT AND TRADEMARK OFFICE

CERTIFICATE OF CORRECTION

PATENT NO. : 5,594,538 
DATED : January 14, 1997
INVENTOR(S) : Nobuhiko TAKEKOSHI, et al.

It is certified that error appears in the above-indentified patent and that said Letters Patent is hereby corrected as shown below:

COLUMN 1
Line 12, "born " should read --borne --;
Line 47, "collotron" should read --corotron--.
COLUMN 3
Line 41, "Pd," should read --Pd, respectively,--.
COLUMN 4
Line 4, "and-black" should read --and black--;
COLUMN 6
Line 37, "or" should read --as--.
COLUMN 8
Line 14, "jointed" should read --joined--.
COLUMN 9
Line 49, "wounded." should read --wound.--
COLUMN 10
Line 3, "in" (second occurance) should be deleted;
Line 7, "10" should be deleted;
Line 49, "members 4" should read --member 4--.

UNITED STATES PATENT AND TRADEMARK OFFICE

CERTIFICATE OF CORRECTION

PATENT NO. : 5,594,538

DATED : January 14, 1997

INVENTOR(S) : Nobuhiko Takekoshi, et al.

It is certified that error appears in the above-indentified patent and that said Letters Patent is hereby corrected as shown below:

COLUMN 13

Line 44, "born " should read --borne --;

Line 50, "born " should read --borne --.

COLUMN 12

Line 51, "born " should read --borne --.

COLUMN 14

Line 9, "born " should read --borne --;

Line 13, "born," should read --borne --;

Line 44, "born " should read --borne --;

Line 53, "born " should read --borne --.

Signed and Sealed this

Eighth Day of July, 1997

Bruce Lehman

*Attest:*

BRUCE LEHMAN

*Attesting Officer*

*Commissioner of Patents and Trademarks*